US006310556B1

(12) United States Patent
Green et al.

(10) Patent No.: US 6,310,556 B1
(45) Date of Patent: Oct. 30, 2001

(54) APPARATUS AND METHOD FOR DETECTING A LOW-BATTERY POWER CONDITION AND GENERATING A USER PERCEPTIBLE WARNING

(75) Inventors: Robert Sherman Green, Sandy, UT (US); Benjamin Edward Nise, Plano, TX (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

(21) Appl. No.: 09/503,589

(22) Filed: Feb. 14, 2000

(51) Int. Cl.[7] ..... G08B 21/00

(52) U.S. Cl. ..... 340/636; 340/635; 340/539; 340/628; 320/43; 320/44; 320/39; 445/38.3

(58) Field of Search ..... 340/636, 635, 340/539, 628; 320/43, 44, 39; 445/38.3

(56) References Cited

U.S. PATENT DOCUMENTS

| | | | | |
|---|---|---|---|---|
| 4,114,149 | | 9/1978 | Kendall | 340/347 |
| 4,660,027 | * | 4/1987 | Davis | 340/636 |
| 4,701,958 | | 10/1987 | Neth | 381/68 |
| 4,982,317 | | 1/1991 | Mauthe | 363/60 |
| 5,155,428 | * | 10/1992 | Kang | 320/13 |
| 5,438,270 | * | 8/1995 | Harper et al. | 324/429 |
| 5,442,345 | * | 8/1995 | Kwon | 340/825.46 |
| 5,551,953 | * | 9/1996 | Lattin et al. | 604/20 |
| 5,684,404 | * | 11/1997 | Millar | 324/426 |
| 5,696,437 | * | 12/1997 | Panther et al. | 320/43 |
| 5,721,482 | * | 2/1998 | Benvegar et al. | 320/43 |
| 5,900,734 | * | 5/1999 | Munson | 324/433 |
| 6,023,517 | | 2/2000 | Ishige | 381/315 |

* cited by examiner

*Primary Examiner*—Daniel J. Wu
*Assistant Examiner*—Tai T. Nguyen
(74) *Attorney, Agent, or Firm*—Thelen Reid & Priest LLP; David B. Ritchie

(57) ABSTRACT

A system for detecting a low battery power condition and providing an audible warning of such a condition to a user of an electronic device such as a hearing aid is disclosed. In one embodiment, the battery output voltage is monitored and compared to a first threshold voltage at specified sampling intervals. When a battery output voltage measurement below the first threshold voltage is detected, this measurement is verified by a rule specifying that a low battery condition is not deemed to exist unless a predetermined percentage of voltage measurements within a predetermined time interval indicate that the battery output voltage is below the first threshold voltage. If the low battery condition is verified, an audible warning is generated, which is repeated at specified warning intervals. This audible warning affords an opportunity to the user for replacing the batteries in the device before loss of operation or degraded sound quality are experienced. Even after generation of the first warning signal, the electronic device continues to function essentially normally for some time. Once the electronic device enters a low battery power condition state, the audible warnings are repeated at specified warning intervals, and the battery output voltage is monitored and compared to a second threshold voltage at specified sampling intervals. If the preliminary warnings are unheeded by the user and the battery output voltage drops below the second threshold voltage, the system generates a final warning and shuts down the output stage of the electronic device. However, until this final warning is generated, the hearing aid device continues to function essentially normally, without at any instant compromising of the effective functioning of the device.

16 Claims, 5 Drawing Sheets

APPARATUS AND METHOD FOR DETECTING A LOW-BATTERY POWER CONDITION AND GENERATING A USER PERCEPTIBLE WARNING

BACKGROUND OF THE INVENTION

1. Field of the Invention

This invention relates generally to the field of battery-powered audio electronic devices. More particularly, the invention relates to the generation of warning signals to the users of battery operated electronic devices such as hearing aids of the impending need to replace batteries, and specifically to the field of providing a low battery power condition detector capable of generating an audible warning and initiating subsequent system shutdown in such devices if necessary.

2. The Background Art

Battery operated electronic devices are commonly known in the art. As is known to those skilled in the art, battery operated electronic devices for audio applications may suffer a sound quality loss as the batteries begin to reach a stage of depletion. For example, in the case of battery operated hearing aid devices, once the charge on the hearing aid battery is depleted beyond a certain point, the hearing aid no longer functions normally. At this point, the user of the device may experience a reduced benefit, or in some cases even an adverse effect, from the device. In some instances, the user may experience such reduced benefits or adverse effects as a drop in the amplification gain of the device, a reduced output volume, an extreme distortion or noise, increased noise, or even the generation of uncomfortable and intolerable sounds. Such a sudden loss of normal operation in a hearing aid device owing to battery depletion without any forewarning could pose a dangerous hazard, not only to the user but also to individuals in close proximity to the user. Harm caused to the other individuals occurs in several instances, especially where a user is operating a motor vehicle or heavy machinery.

In the field of battery operated audio electronic devices such as hearing devices, there is a current lack of systems with built-in annunciation mechanisms which can assist in the generation of a warning signal to the user to indicate that the battery in the hearing aid device is running low and needs replacement. Most systems known in the art for implementing low battery warning systems in hearing aids may provide a single fixed voltage comparison threshold to which the battery output voltage is compared. However, the difficulty encountered in these systems is that a single fixed voltage may not necessarily provide the optimum tradeoff between long battery life and adequate warning time for the user. An additional problem posing some of these systems is that increase of a battery's internal impedance as it approaches the end of its life makes the hearing aid susceptible to large voltage transients at its power supply. These transients could falsely trigger the low battery detector typically used in such systems, and reduce the perceived battery life of the hearing aid.

Thus, a need exists for an electronic hearing aid device which could, with the help of such an annunciation mechanism, detect a low battery condition and provide an audible warning to the user while the battery is charged sufficiently such that the hearing aid device is still able to continue its normal operation. Moreover, such a mechanism should be able to confirm that a low battery condition actually exists before generating such a warning, so that a user is not falsely warned that the batteries need replacing.

Finally, because circuit area is limited in electronic devices such as those used in hearing aid applications, the circuitry used to implement such an annunciation mechanism should be capable of being shared for other purposes. Unfortunately, no current mechanism exists to provide these functions and enable these activities.

The present invention provides a built-in low battery power detection system for use in electronic devices such as hearing aids that generates audible warnings to the user to indicate a low battery power condition. According to aspects of the present invention, the user is afforded an opportunity to replace the batteries of the hearing aid device before an adverse loss of operation occurs. According to other aspects of the present invention, the electronic device is further designed to shut down in a predictable and comfortable manner at some time after the generation of the low battery warning, thus protecting the user against the generation of uncomfortable sonic artifacts. The current invention can be used in any battery powered audio electronic device, including hearing devices and other similar communication equipment.

Thus, the present invention provides a built-in system to detect a low battery power condition and to generate audible warning signals to indicate that the battery is low. However, even after generation of such warnings signal, the electronic device continues to function normally for some time. If this preliminary warning indicating low battery goes unheeded by the user and he/she fails to replace the battery, the system may generate a final warning and subsequently shut down the audio output stage of the electronic device. However, until this final warning is generated, the hearing aid device essentially continues to function normally, without at any instant compromising of the effective functioning of the device. Thus, even when total battery depletion causes the shut down of the electronic device, there are no adverse effects to the user. These and other features and advantages of the present invention will be presented in more detail in the following specification of the invention and in the associated figures.

SUMMARY OF THE INVENTION

A system for detecting a low battery power condition and providing an audible warning of such a condition to a user of an electronic device such as a hearing aid is disclosed. In one embodiment, the battery output voltage is monitored and compared to a first threshold voltage at specified sampling intervals. When a battery output voltage measurement below the first threshold voltage is detected, this measurement is verified by a rule specifying that a low battery condition is not deemed to exist unless a predetermined percentage of voltage measurements within a predetermined time interval indicate that the battery output voltage is below the first threshold voltage. If the low battery condition is verified, an audible warning is generated, which is repeated at specified warning intervals. This audible warning affords an opportunity to the user for replacing the batteries in the device before loss of operation or degraded sound quality are experienced. Even after generation of the first warning signal, the electronic device continues to function essentially normally for some time. Once the electronic device enters a low battery power condition state, the audible warnings are repeated at specified warning intervals, and the battery output voltage is monitored and compared to a second threshold voltage at specified sampling intervals. If the preliminary warnings are unheeded by the user and the battery output voltage drops below the second threshold voltage, the system generates a final warning and shuts down the output stage of the electronic device. However, until this final warning is generated, the hearing aid device continues to function essentially normally, without at any instant compromising of the effective functioning of the device.

BRIEF DESCRIPTION OF THE DRAWINGS

The accompanying drawings, which are incorporated in and constitute a part of this specification, illustrate an embodiment of the invention and, together with the present description, serve to explain the principles of the invention.

In the drawings.

DETAILED DESCRIPTION

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to an implementation of the present invention as illustrated in the accompanying drawings. The same reference numbers will be used throughout the drawings and the following description to refer to the same or like parts.

Figure 1:
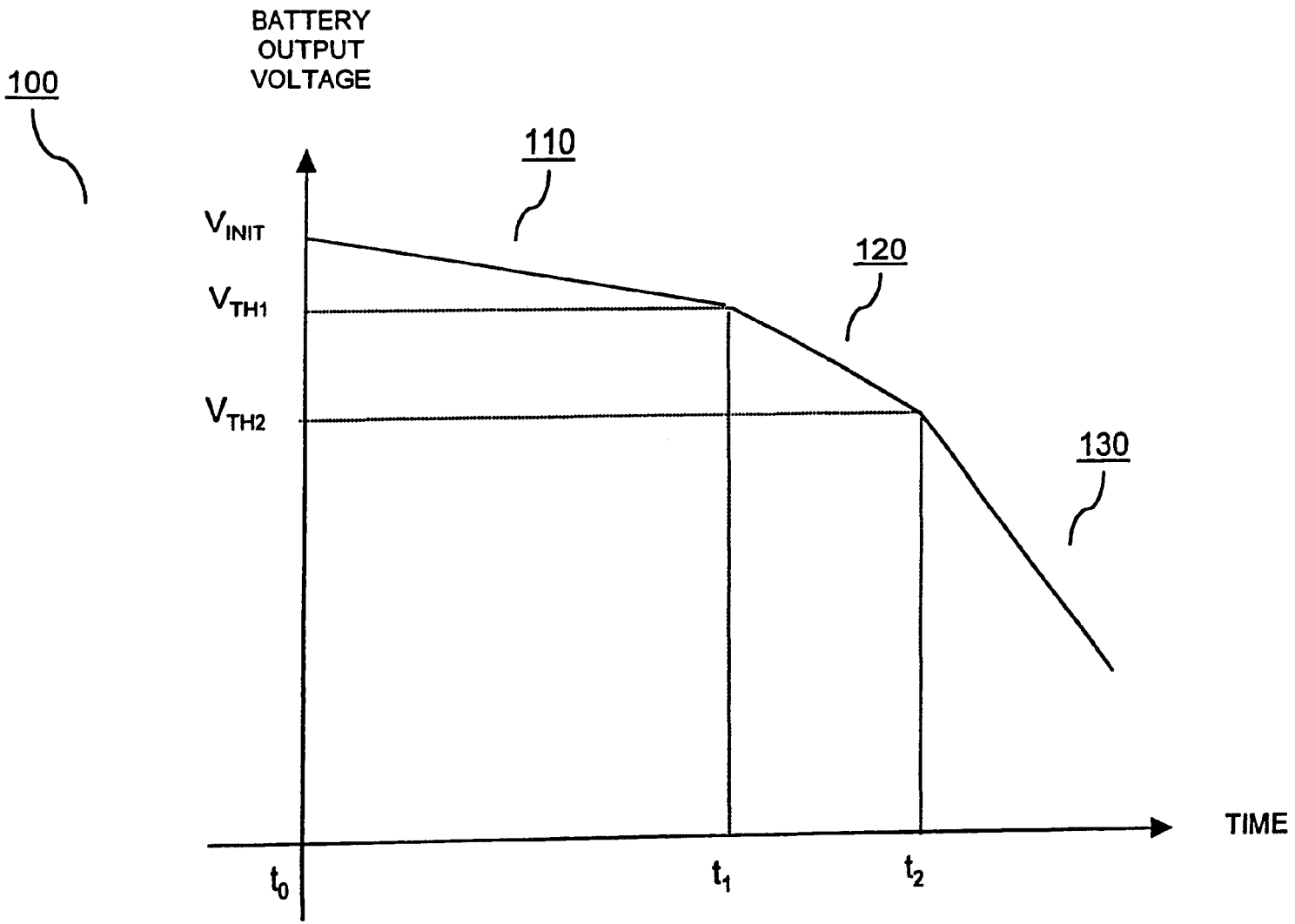
FIG. 1 is a diagram illustrating a piecewise linear model of a typical battery output voltage decay process that is used according to aspects of the present invention.

FIG. 1 is a diagram illustrating a piecewise linear model 100 of a typical battery output voltage decay process that is used according to aspects of the present invention, with elapsed time indicated along the horizontal axis and battery output voltage indicated along the vertical axis. As is known to those skilled in the art, the output voltage of a battery will gradually drop from its initial fully-charged value as the battery's charge is depleted with normal operation of the device to which it is attached. As shown in FIG. 1, for the purposes of the present invention, the battery output voltage decay function is modeled as a piecewise linear function comprising three regions 110, 120, and 130. When a new battery is fully charged, at time to its output voltage starts off at $V_{INIT}$. With normal operation of the device to which the battery is attached, the output voltage gradually drops, until at time $t_1$, it reaches a first threshold voltage, $V_{TH1}$. This first operating region 110 can be described as the optimal operating region of the device to which the battery is attached. In an audio device application such as a hearing aid, as long as the battery output voltage does not drop below $V_{TH1}$, a user will typically not perceive any loss in sound quality even though the battery output voltage may have dropped significantly from its initial value. Typically, the device will operate in its optimal operating region 110 for a relatively long time, and the voltage drop at time $t_1$ will typically be relatively low.

It turns out that even after the battery output voltage has dropped below $V_{TH1}$, a battery operated audio electronic device such as a hearing aid may continue to function essentially normally for some time, as long as the battery output voltage does not drop below a second threshold voltage, $V_{TH2}$. By definition, while the device operates in this second voltage region 120, the perceived sound quality of the device is not noticeably inferior from the standpoint of a typical user. However, when the device begins to operate in region 120, the user should be warned that the battery should be replaced. As shown in FIG. 1, assuming a constant operating environment for the audio electronic device, region 120 will typically be of shorter duration than optimal operating region 110. Even so, the device will typically operate within region 120 for a reasonably long period of time that enables a user to change the battery before the perceived sound quality of the device becomes inferior, or even inoperable.

Once the battery output voltage drops below $V_{TH2}$ (i.e., once the device has entered operating region 130) the perceived sound output quality of the device will be noticeably inferior from the standpoint of a typical user, and a point will be reached when the battery output voltage is so low that the device attached to the battery will not be able to operate at all. Once a device such as a hearing aid enters operating region 130, the preferable course of action is to shut down the device, or to at least to shut down the audio output circuitry of the device so as to prevent harm to the user or to people in close proximity to the user. Because the audio output can in some cases be severely distorted, the device is preferably shut down before this can happen.

It must be emphasized that the values of $V_{TH1}$ and $V_{TH2}$ are dependent on the circuit configuration and application requirements of each particular implementation. However, these values can easily be determined for a particular implementation by those skilled in the art using conventional experimental methods. Moreover, in applications such as hearing aid applications, the values of $V_{TH1}$ and $V_{TH2}$ depend on the subjective sound quality perceived by users. Therefore, the threshold voltage values are preferably determined using an experimental process based at least in part on a survey of user reactions to the sound quality perceived as a function of battery supply voltage. For example, in one implementation, the values for $V_{TH1}$ and $V_{TH2}$ may be set at 90% and 80%, respectively, of the nominal value of $V_{INIT}$ for a typical battery. However, these values may be completely inadequate for use with other implementations.

Also, it is to be understood that the model shown in FIG. 1 has been simplified for the purposes of the present invention. The actual output voltage decay function of a battery may be much more complex, and dependent on several factors known to those skilled in the art. However, the simple model shown in FIG. 1 is sufficiently analytically complex to form the basis for one embodiment of the present invention, as will be discussed in more detail below. It should also be noted that the battery output voltage will typically be noisy, due to switching transients in the circuitry attached to the battery and due to other factors known to those skilled in the art.

Figure 2:
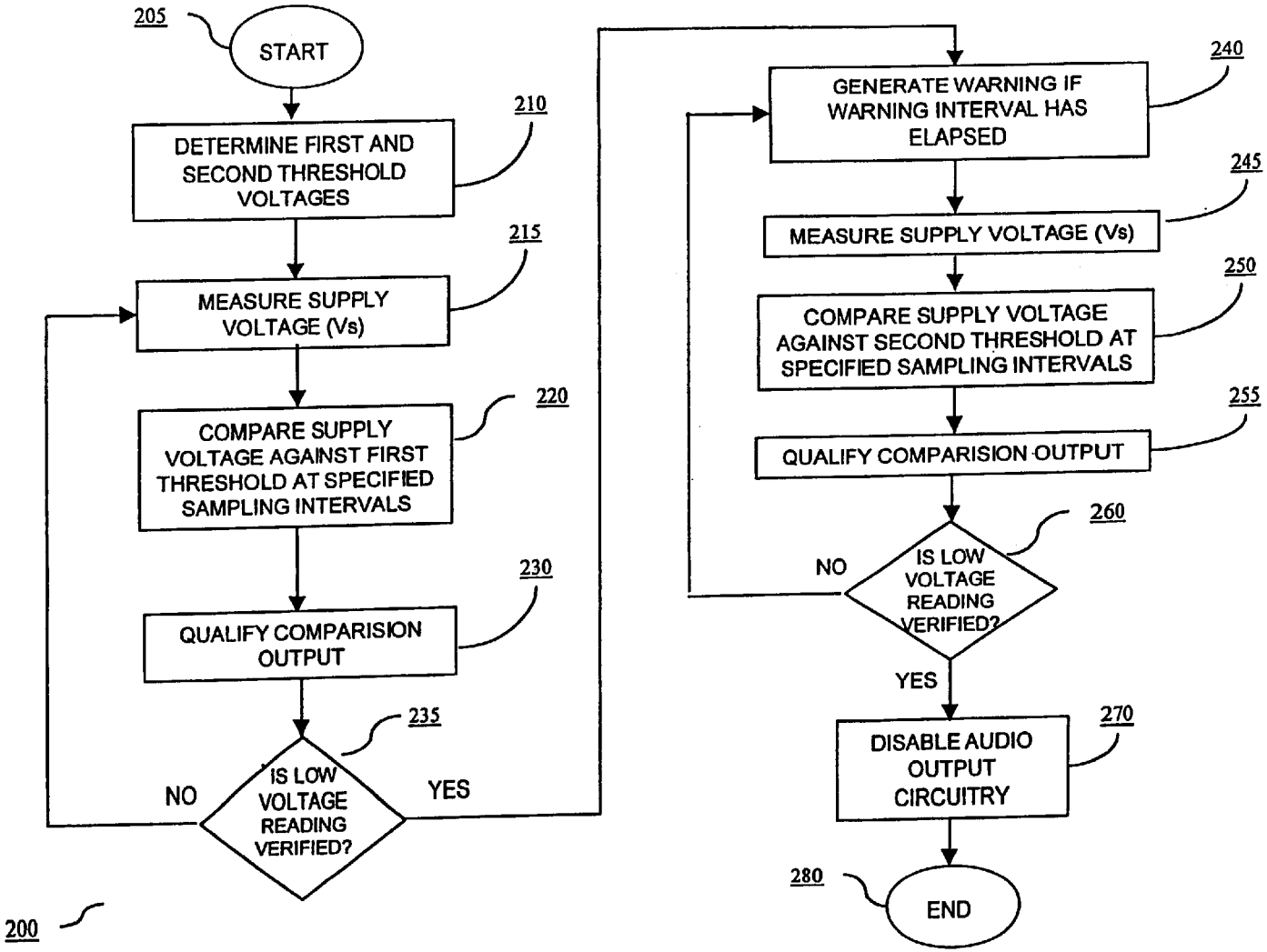
FIG. 2 is a flow diagram illustrating a method for low battery power detection and warning according to aspects of the present invention.

FIG. 2 is a flow diagram illustrating a method 200 for low battery power detection and warning according to aspects of the present invention. An exemplary circuit for implementing the method shown in FIG. 1 on an electronic audio device such as a hearing aid will be described subsequently in this document. As illustrated in FIG. 1, the method 200 begins at step 205, and at step 210, the two low battery voltage thresholds $V_{TH1}$ and $V_{Th2}$ mentioned above are determined. Step 210 is typically performed experimentally during the device design process, such that the voltage thresholds are typically fixed at their predetermined values for the entire time that the electronic device is in operation. However, if so desired for a particular implementation, these thresholds may be externally reprogrammable so as to be capable of being customized for a particular user, or may even be dynamically and automatically determined during operation of the device. Some time after step 210 has taken place, it is assumed that a new or replacement battery is inserted into the electronic device.

Once the electronic device has been equipped with a new or replacement battery, the device begins its normal operation. At step 215, the battery output voltage $V_S$ is measured at specified sampling intervals, which depend on the requirements of each particular implementation. In one embodiment used with a hearing aid application, the battery output voltage is measured at a sampling rate of 1.28 MHz. At step 220, the measured battery output voltage is compared with the first threshold voltage, $V_{TH1}$. As will be discussed in more detail later in this document, in a circuit implementation, the measuring and comparing steps may be combined into a single step by using a conventional comparator circuit known to those skilled in the art.

If the measured battery output voltage is below the first threshold voltage, the device may have transitioned from optimal operating region 110 of FIG. 1 into region 120. However, the low voltage reading obtained at step 215 of FIG. 2 may have actually been caused by the rise in battery impedance as the battery discharges, which can cause voltage transients that may erroneously trigger the detector due to the current draw of the device attached to the battery. From a user's standpoint, false detection of a low battery condition is highly undesirable and should be avoided. Therefore, at step 230, the output of the voltage comparison is qualified to minimize the occurrence of false alarms. As will be described further below, the use of high frequency sampling of the output of a comparator is a very efficient means of low pass filtering the battery voltage.

In one embodiment, step 230 is performed by using a process that can be described functionally as follows. A relatively large number of consecutive battery output voltage readings (e.g., 131,072 consecutive samples) are compared against the first threshold voltage, and if more than half of the readings are below the first threshold voltage, the low voltage reading is deemed to be verified. A simple circuit for implementing this function will be described more fully in subsequent portions of this document.

Still referring to FIG. 2, at step 235 a decision is made based on the result of qualification step 230. At step 235, if the voltage comparison is not qualified (indicating that the device is probably still operating within range 110 of FIG. 1) the process loops back to step 215. Otherwise (i.e., if the voltage comparison is qualified), shut down mode of the device is initiated at step 240, meaning that the device is deemed to have transitioned into operating region 120 of FIG. 1. At this point (i.e., at step 240), an audible or otherwise user perceptible warning is generated. In one embodiment, this warning consists of a sequence of four short tones emitted at a volume loud enough to be noticeable by a hearing aid user, yet preferably not so loud that the user is startled. Specifically, in one embodiment, each of the four short tones is spaced by approximately 0.5 sec of silence, and the sequence of tones is repeated at approximately 3.5 minute intervals. In this embodiment, the loudness of these warning tones are programmable to different levels, and the warning tones can be disabled entirely if the user so desires.

At step 245, the battery output voltage continues to be measured at the normal sampling rate (e.g., 1.28 MHz), and at step 250, the measured battery output voltage is once again compared to a threshold, except that the second threshold voltage value, $V_{TH2}$, is now used for the comparison. If the measured battery output voltage is below the second threshold voltage, the device may have transitioned from region 120 of FIG. 1 into region 130. However, due to noise and other factors, the low voltage reading obtained at step 245 of FIG. 2 may have been a false alarm. Therefore, at step 255, the output of the comparison is qualified using the same process that had been used at step 230.

At step 260, if the voltage comparison is not qualified (indicating that the device is probably still operating within range 120 of FIG. 1), the process loops back to step 240. It should be noted that although the loop formed by steps 240, 245, 250, 255, and 260 repeats at the battery output voltage sampling rate (e.g., 1.28 MHz), a warning is only generated during step 240 if the warning interval time has elapsed (e.g., approximately 3.5 minutes).

Otherwise, if the voltage comparison is qualified at step 260, final shut down mode of the device is initiated at step 270, meaning that the device is deemed to have transitioned into operating region 130 shown in FIG. 1. At this point (i.e., at step 270 of FIG. 2), the audio output circuitry of the electronic device is disabled in one embodiment to prevent harm to the user or to other people in close proximity to the user, due to the loud and possibly highly distorted sounds that may be generated. As those skilled in the art will recognize, the actual events that are caused to occur as a result of initiating step 270 will vary depending upon the requirements of each implementation. For example, in some cases it may be desirable to shut down the entire device, while only selected portions of the device may be shut down in other implementations. Finally (although this is not preferable), the device may simply continue to generate warnings until the device can no longer function.

It should be noted that if a battery with less than full charge is inserted into the device (e.g., by mistake, or due to a defect in the battery), the device may operate under a modified version of the method illustrated in FIG. 2. For example, if the battery output voltage is still above $V_{TH1}$ when such a battery is inserted, the user may be warned at the first opportunity that the battery already needs replacement. Otherwise, the battery output voltage may be so low that no warning is possible, in which case the device may simply shut down shortly after battery insertion, or may not operate at all.

Figure 3:
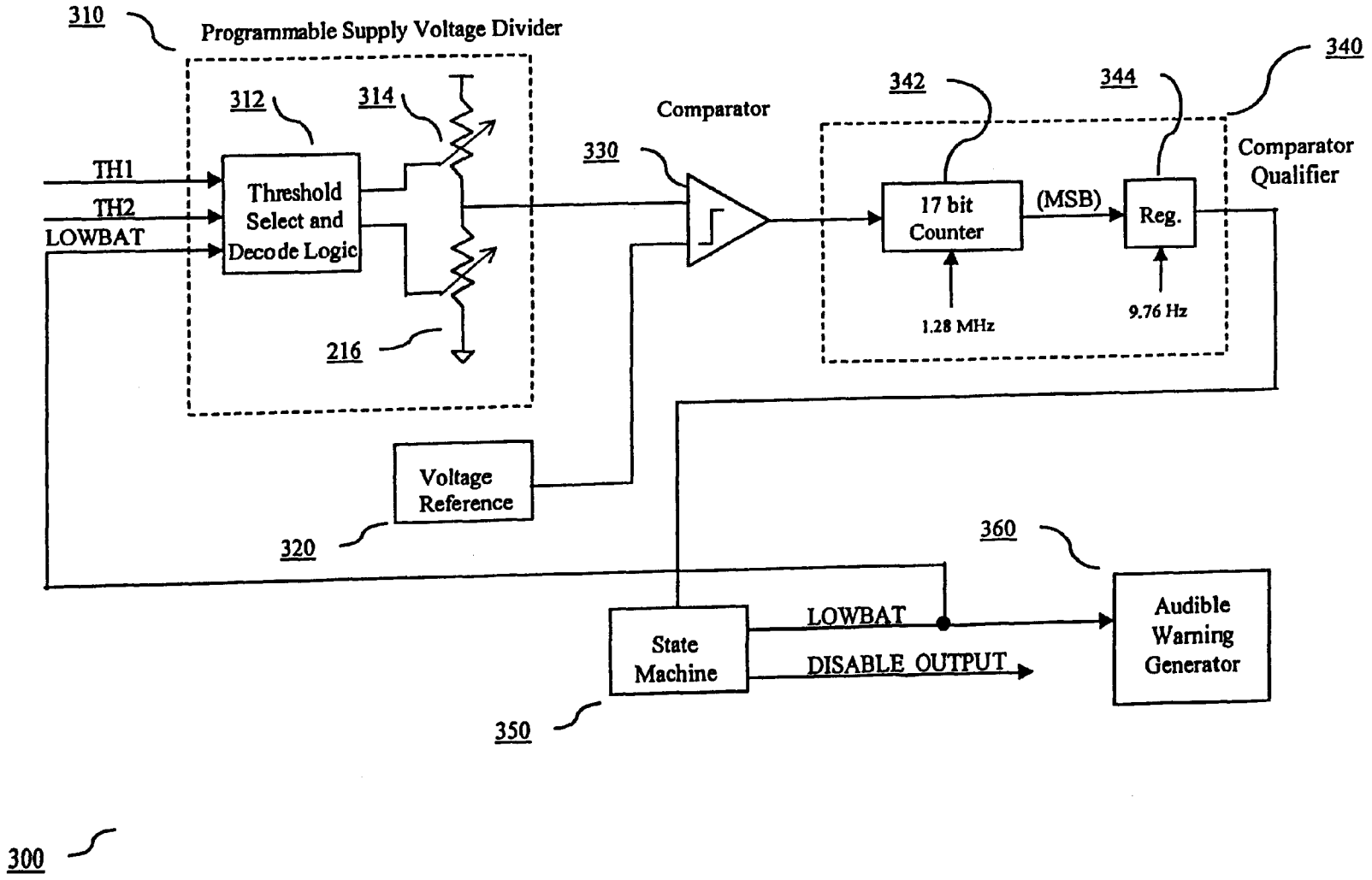
FIG. 3 is a block diagram illustrating a circuit suitable for implementing a method for low battery power detection and warning according to aspects of the present invention.

FIG. 3 is a block diagram illustrating a circuit suitable for implementing a method for low battery power detection and warning according to aspects of the present invention. As shown in FIG. 3, low battery power detection and warning circuit 300 comprises a programmable supply voltage divider 310, voltage reference 320, comparator 330, comparator qualifier 340, state machine 350, and audible warning generator 360. In one embodiment, programmable supply voltage divider comprises threshold select and decode logic and two programmable potentiometers 314, 316. The inputs to threshold select and decode logic 312 are two digital values representing the values of $V_{TH1}$ and $V_{Th2}$ and a digital signal named LOWBAT, to be described in more detail below, that indicates whether the electronic device attached to the battery is still operating within region 110 of FIG. 1 or not. Referring back to FIG. 3, the output of programmable supply voltage divider 310 forms one input to comparator 330. Those skilled in the art will recognize that according to the circuit configuration shown in FIG. 3, threshold select and decode logic 312 should be designed such that when the LOWBAT signal is in a first state (i.e., indicating that the device is operating within region 110 of FIG. 1), the voltage output of programmable supply voltage divider 310 should be set to equal the analog value of $V_{TH1}$ by setting the values of programmable potentiometers 314 and 316 appropriately. Likewise, when the LOWBAT signal is in a second state (i.e., indicating that the device is not operating within region 110 of FIG. 1), the values of programmable potentiometers 314 and 316 should be set such that voltage output of programmable supply voltage divider 310 equals the analog value of $V_{TH2}$.

Still referring to FIG. 3, voltage reference 320 represents the battery output voltage to be monitored. As is known to those skilled in the art, comparator 330 can be implemented such the output of comparator 330 is asserted when voltage reference 320 is at a lower level than the output of programmable supply voltage divider 310. Because the absolute value of the battery output voltage is not important (only its relative level with respect to the output of programmable supply voltage divider 310), a conventional comparator 330 simultaneously provides the functions of measuring and comparing the two voltages with respect to each other.

Comparator qualifier 340 is a simple circuit that can be used to implement steps 230 and 255 of FIG. 2. Referring back to FIG. 3, in one embodiment comparator qualifier 340 comprises a 17-bit counter 342 and a register 344. Counter 342 is clocked at a rate of 1.28 MHz, taking advantage of a clock frequency already available in the electronic device. It should be noted that counter 342 is reset to zero at a rate of 9.76 Hz, which equals the 1.28 MHz sample clock rate divided down seventeen times. It should also be mentioned that the counter circuit dissipates very little power when the power supply is greater than the comparator threshold.

The output of comparator 330 is connected to the count enable input of counter 342 in a manner known to those skilled in the art, such that counter 342 is only incremented on clock cycles where the output of comparator 330 is asserted. Register 344 is latched at a 9.76 Hz rate, with its output dependent on the state of the Most Significant Bit ("MSB") of counter 342 at the time that register 344 is latched. A delayed version of the 9.76 Hz clock used to latch register 344 is also used to reset counter 342. As those skilled in the art will recognize, the control signals of counter 342 and register 344 should be designed such that the output of comparator qualifier 340 is asserted if and only if the majority of voltage comparisons taken at a 1.28 MHz rate within the 9.76 Hz qualification rate indicate that the voltage reference 320 is at a lower level than the output of programmable supply voltage divider 310. Thus, comparator qualifier 340 reduces the possibility of false low voltage readings due to noise or other factors. If most of the samples are high within a qualification period (i.e., at a 9.76 Hz rate), that is an indication that the voltage reference 320 is consistently lower than a voltage threshold generated by programmable supply voltage divider 310, which in turn means that the battery is probably running low.

Figure 4:
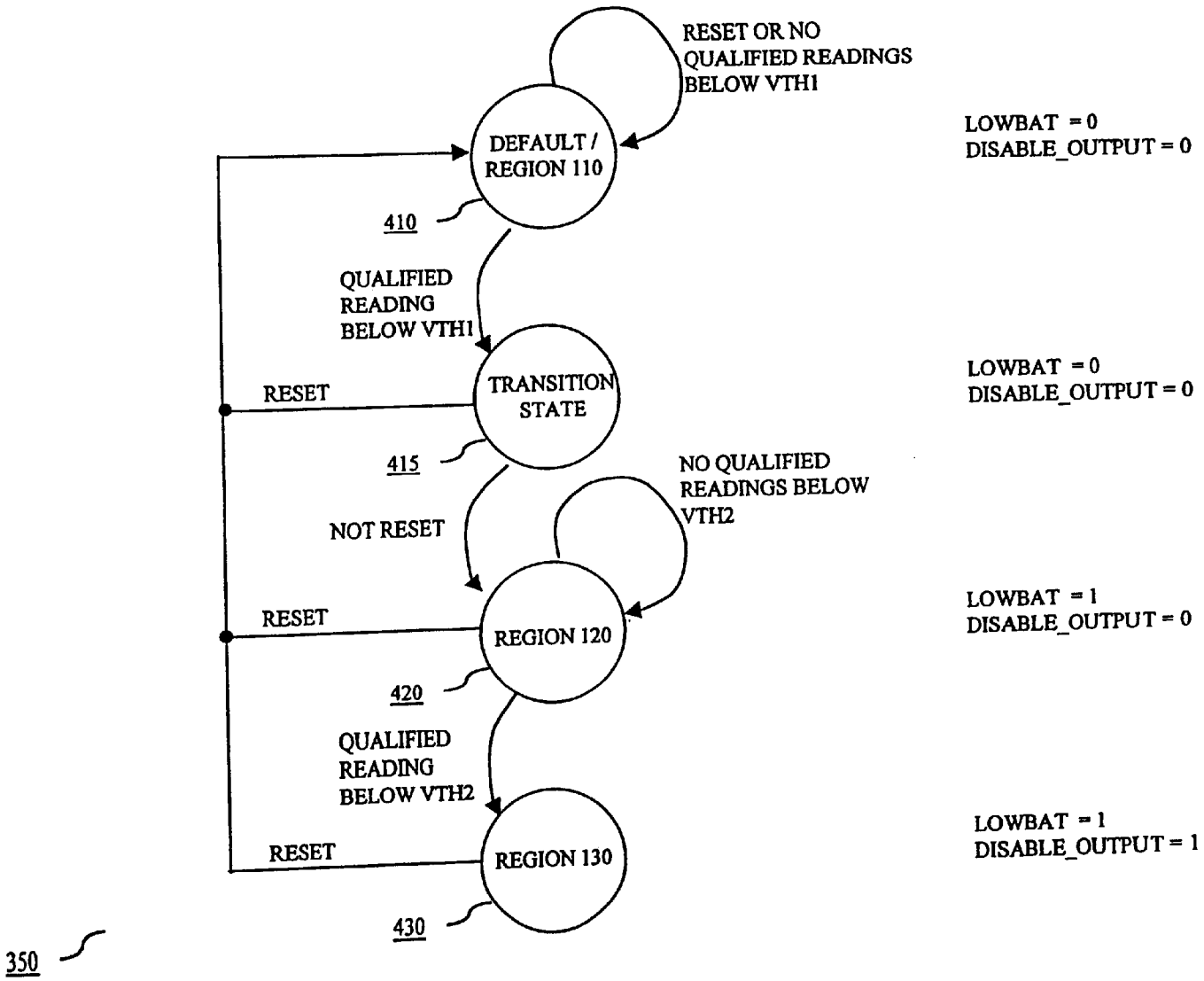
FIG. 4 is a block diagram illustrating a state transition diagram suitable for use with one embodiment of the present invention.

In one embodiment, state machine 350 examines the output of comparator qualifier 340 and generates binary two signals: LOWBAT and DISABLE_OUTPUT. FIG. 4 is a block diagram illustrating a state transition diagram suitable for use with state machine 350 in one embodiment of the present invention. As shown in FIG. 4, state machine 350 comprises four states: Default/"Region 110" state 410, Transition state 415, "Region 120" state 420, and "Region 130" state 430. As indicated in FIG. 4, a reset signal (not shown in the figures) will always cause the state machine to transition to default state 110 on the next clock cycle.

Still referring to FIG. 4, assuming that state machine 350 has just been reset, it will transition to state 410. In state 410, LOWBAT is not asserted, and DISABLE_OUTPUT is not asserted, indicating that the device is currently operating within optimal operating region 110 of FIG. 1. As long as the output of comparator qualifier circuit 340 of FIG. 3 is not asserted, state machine 350 will remain in state 410.

If the output of comparator qualifier circuit 340 of FIG. 3 is asserted when state machine is in state 410, state machine 350 will enter state 415. State 415 is a transition state that lasts a single clock cycle, during which the voltage thresholds for the comparison are switched from the first threshold voltage, $V_{TH1}$, to the second threshold voltage, $V_{TH2}$. During state 415, LOWBAT is not asserted, and DISABLE_OUTPUT is also not asserted. However, as is known to those skilled in the art, internal state variables must somehow indicate that state machine 350 is now in a different state. State 415 is necessary to ensure that the DISABLE_OUTPUT signal is not asserted during the time that the voltage thresholds are being changed. Assuming the device is not reset, the state machine will always switch to state 420 on the next clock cycle after entering state 415.

Upon entering state 420, LOWBAT is asserted, but DISABLE_OUTPUT is still not asserted. State 420 indicates that the electronic device attached to the battery has now entered low battery operating region 120 of FIG. 1. The assertion of the LOWBAT signal causes several events to take place. First, programmable supply voltage divider 310 of FIG. 3 is commanded to generate the second voltage threshold, $V_{TH2}$, instead of the first voltage threshold, $V_{TH1}$ (those skilled in the art will recognize that this threshold switching step was actually performed during state 415). Second, audible warning generator 360 of FIG. 3 is commanded to begin generating audible warnings at regular intervals. As has been mentioned earlier, in one embodiment, this warning consists of a sequence of four short tones spaced by approximately 0.5 sec of silence, with the sequence of tones being repeated at approximately 3.5 minute intervals. While state machine 350 is in state 420, as long as the output of comparator qualifier circuit 340 of FIG. 3 is not asserted or the device is not reset, state machine 350 will remain in state 420.

If the output of comparator qualifier circuit 340 of FIG. 3 is asserted when state machine is in state 420, state machine 350 will transition to state 430. At this point, LOWBAT remains asserted, and DISABLE_OUTPUT is also asserted. State 430 indicates that the electronic device attached to the battery has now entered extremely low battery operating region 130 of FIG. 1, perhaps because the audible warnings generated during state 420 went unheeded and the battery was not replaced in time. The assertion of the DISABLE_OUTPUT signal causes the audio output circuitry of the electronic device to be shut down. Once state machine 350 is in state 430, only the assertion of a reset signal can cause state machine 350 to exit state 430 and return to default state 410.

Figure 5:
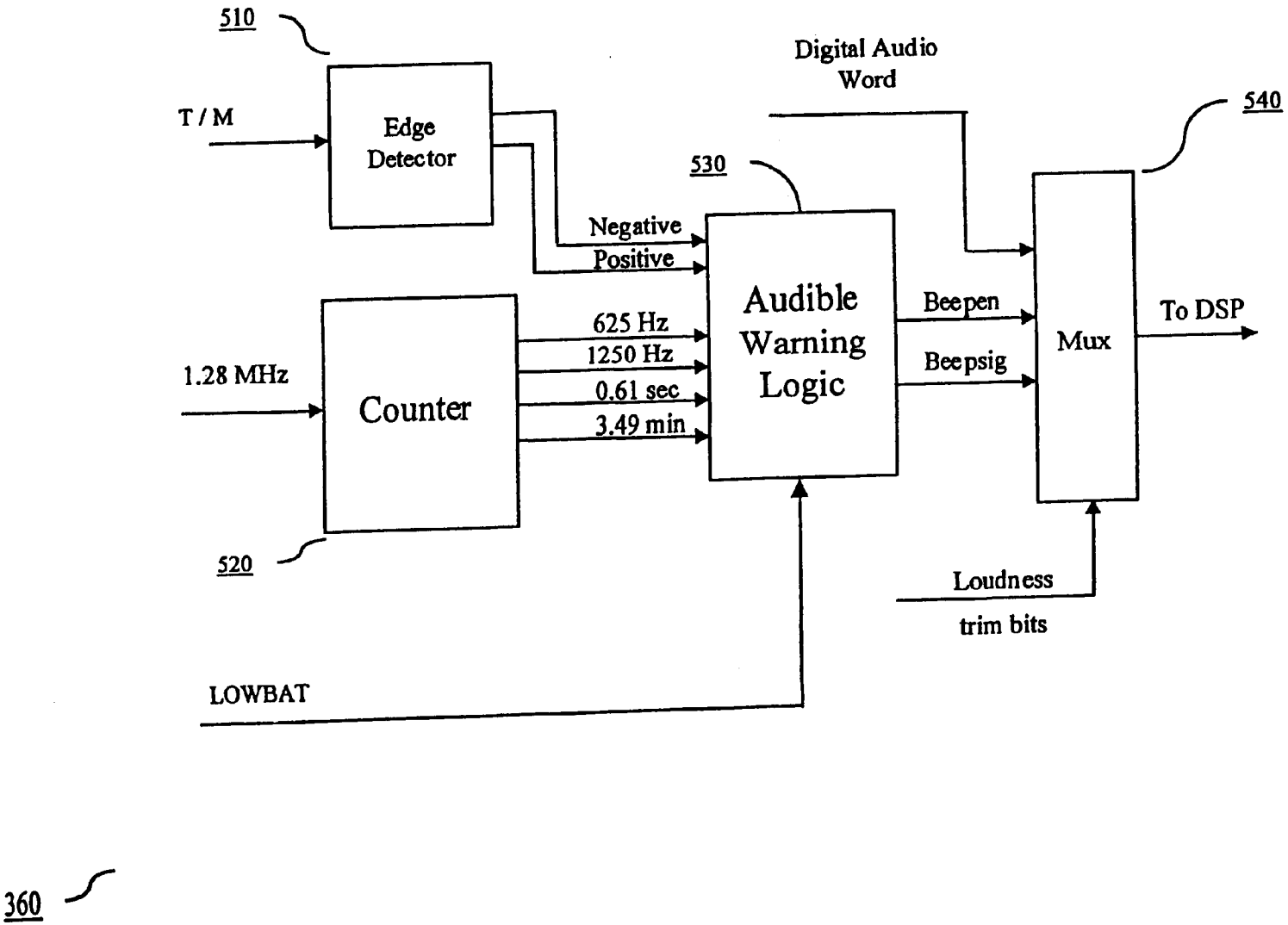
FIG. 5 is a block diagram illustrating a warning generation circuit suitable for use with one embodiment of the present invention.

FIG. 5 is a block diagram illustrating an audible warning generation circuit 360 suitable for use with one embodiment of the present invention. As shown in FIG. 5, audible warning generation circuit 360 comprises edge detector 510, counter 520, audible warning logic 530, and multiplexer ("mux") 540.

Edge detector 510 is a conventional circuit for detecting whether a binary input signal has switched states, and in what direction. In one embodiment of the present invention used in hearing aid applications, there is a user-controllable switch that determines whether a microphone or telecoil audio input device is used. By adding edge detector 510 to audible warning generator circuit 360, audible warning generator 360 can provide audible feedback to the user whenever a user controllable switch such as the Telecoil-microphone ("T/M") switch is thrown. In one embodiment, if a positive edge is detected (e.g., if the user switches from microphone input to telecoil input), audible warning generator circuit 360 generates a low frequency tone (e.g., 625 Hz) followed by a high frequency tone (e.g., 1250 Hz). Conversely, if a negative edge is detected (e.g., if the user switches from telecoil input to microphone input), audible warning generator circuit 360 generates a high frequency tone followed by a low frequency tone. Those skilled in the art will recognize that signals derived from user-controllable actions should be debounced. Also, it is to be understood that this aspect of the present invention can be applied in an situation where it is desired to provide audible or other user perceptible feedback to a user as a result of any control signal being manipulated by the user.

Still referring to FIG. 5, counter 520 is used in a manner known to those skilled in the art to generate the audio and control frequencies required in one embodiment. Specifically, in one embodiment, counter 520 is used to divide down a 1.28 MHz signal to generate signals at 1250 Hz (for the high frequency tone), 625 Hz (for the low frequency tone), 0.61 seconds (the low battery beep separation interval), and 3.49 minutes (the low battery warning separation interval).

In one embodiment, audible warning logic 530 of FIG. 5 combines the negative and positive edge detection signals generated by edge detector 510 with the 1250 Hz, 625 Hz, 0.61 Hz, and 3.49 minute rate signals generated by counter 520 and the LOWBAT signal generated by state machine 350 in a manner known to those skilled in the art to generate a "Beepen" output and a "Beepsig" output. These signals are routed to mux 540, along with loudness trim bits and a digital audio word, both of which are generated in other parts of the electronic device to which the battery is attached.

In one embodiment used with a hearing aid application, when a tone is to be generated, the "Beepen" signal is asserted by audible warning logic 530, causing the normal digital audio word generated by an A/D converter (not shown) connected to the microphone or telecoil audio input device (not shown) to be deselected and the "Beepsig" value to be selected. The "Beepsig" signal is a digital value indicating a square wave at the frequency of the beep to be generated, and causes a tone at the beep frequency to be generated by Digital Signal Processing ("DSP") and audio output stages of the electronic circuit to which the battery is attached (not shown). Loudness trim bits (with two such bits in one embodiment) allow for four loudness levels to be generated by changing the amplitude of the digital values sent to the DSP. However, the beep level amplification is controlled to be the same as the amplification level of a normal audio signal from the microphone, since they are both processed by the same DSP algorithm. If so desired for a particular implementation, it is possible to set the beep level independently of the hearing aid amplification.

By utilizing the comparator qualifier circuit 340 of FIG. 3, power supply transients or other types of noise will not tend to trigger a premature low battery warning or shutdown of the output stage of the hearing aid device. Moreover, the utilization of two power supply voltage detection thresholds—the first threshold to start a warning tone sequence and the second threshold to shut down the output stage of the hearing aid device—has a dual significance. First, it helps to provide the system with a timely warning to the user indicating that the battery is low and needs replacement, and second by avoiding the uncomfortable sonic artifacts that may be associated with a dying battery.

While embodiments and applications of this invention have been shown and described, it would be apparent to those of ordinary skill in the art having the benefit of this disclosure that many more modifications than mentioned above are possible without departing from the inventive concepts herein. The invention, therefore, is not to be restricted except in the spirit of the appended claims.

What is claimed is:

1. A method for detecting a low battery condition in an electronic device used in audio applications and generating a user perceptible warning indicating the detection of said low battery condition, comprising:

determining a first voltage threshold and a second voltage threshold;

measuring a battery output voltage and comparing said battery output voltage against said first threshold voltage at specified sampling intervals;

qualifying the output of said comparing step against said first threshold voltage, and if said comparing step against said first threshold voltage is qualified:

generating a user perceptible warning at specified intervals;

continuing to measure said battery output voltage and comparing said battery output voltage against said second threshold voltage at specified sampling intervals; and qualifying the output of said comparing step against said second threshold voltage, and if said comparing step against said second threshold voltage is qualified, disabling the audio output circuitry of or otherwise disabling said electronic device.

2. The method according to claim 1, wherein said electronic device is a hearing aid and said user perceptible warning is an audible warning.

3. The method according to claim 2, wherein said audible warning comprises a sequence of tones.

4. The method according to claim 3, wherein said sequence of tones comprises short tones spaced at approximately half second intervals and wherein said sequence of tones is repeated at intervals of approximately two to ten minutes.

5. An apparatus for detecting a low battery condition in an electronic device used in audio applications and generating a user perceptible warning indicating the detection of said low battery condition, comprising:

means for measuring a battery output voltage and comparing said battery output voltage against a first threshold voltage at specified sampling intervals;

means for qualifying the output of said comparison against said first threshold voltage;

means for generating a user perceptible warning at specified intervals if said comparison against said first threshold voltage is qualified;

means for measuring and comparing said battery output voltage against a second threshold voltage at specified sampling intervals if said comparison against said first threshold voltage is qualified;

means for qualifying the output of said comparison against said second threshold voltage; and means for disabling the audio output circuitry or portions of said electronic device if said comparison against said second threshold voltage is qualified.

6. The apparatus according to claim 5, wherein said electronic device is a hearing aid and said user perceptible warning is an audible warning.

7. The method according to claim 6, wherein said audible warning comprises a sequence of tones.

8. The method according to claim 7, wherein said sequence of tones comprises short tones spaced at approximately half second intervals and wherein said sequence of tones is repeated at intervals of approximately two to ten minutes.

9. An apparatus for detecting a low battery condition in an electronic device used in audio applications and generating a user perceptible warning indicating the detection of said low battery condition, comprising:

a programmable supply voltage divider selectively providing one of a first or a second voltage threshold level in response to a low battery condition detection signal;

a comparator indicating whether a battery output voltage is higher than the output of said programmable supply voltage divider;

a comparator qualifier for preventing false detection of a low battery voltage condition;

a state machine generating said low battery condition detection signal and generating an output disabling signal; and an audible warning generator circuit.

10. The apparatus according to claim 9, wherein said electronic device is a hearing aid and said user perceptible warning is an audible warning.

11. The method according to claim 10, wherein said audible warning comprises a sequence of tones.

12. The method according to claim 11, wherein said sequence of tones comprises short tones spaced at approximately half second intervals and wherein said sequence of tones is repeated at intervals of approximately two to ten minutes.

13. An apparatus for detecting a low battery condition in an electronic device used in audio applications and generating a user perceptible warning indicating the detection of said low battery condition, comprising:

a programmable supply voltage divider selectively providing one of a first or a second voltage threshold level in response to a low battery condition detection signal;

a comparator indicating whether a battery output voltage is higher than the output of said programmable supply voltage divider;

a comparator qualifier for preventing false detection of a low battery voltage condition;

a state machine generating said low battery condition detection signal and generating an output disabling signal; and an audible warning generator circuit, wherein said comparator qualifier is sampled at a first sampling interval and reset at a first qualification interval, and wherein said comparator qualifier indicates whether a plurality of voltage comparisons performed by said comparator at said first sampling interval within said first qualification interval determine that said battery output voltage is lower than the output of said programmable supply voltage divider.

14. The apparatus according to claim 13, wherein said electronic device is a hearing aid and said user perceptible warning is an audible warning.

15. The method according to claim 14, wherein said audible warning comprises a sequence of tones.

16. The method according to claim 15, wherein said sequence of tones comprises short tones spaced at approximately half second intervals and wherein said sequence of tones is repeated at intervals of approximately two to ten minutes.

* * * * *

UNITED STATES PATENT AND TRADEMARK OFFICE

CERTIFICATE OF CORRECTION

PATENT NO. : 6,310,556 B1
DATED : October 30, 2001
INVENTOR(S) : Green et al.

It is certified that error appears in the above-identified patent and that said Letters Patent is hereby corrected as shown below:

Column 3,
Line 51, after "time" replace "to" with -- $t_o$ --.

Column 4,
Lines 61 and 63, after "FIG." replace "1" with -- 2 --.
Line 65, after "and" replace "$V_{Th2}$" with -- $V_{TH2}$ --.

Column 6,
Line 58, after "and" replace "$V_{Th2}$" with -- $V_{TH2}$ --.

Column 9,
Line 15, after "applied in" replace "an" with -- a --.

Column 11,
Lines 4, 6, 30 and 32, after "The" replace "method" with -- apparatus --.

Column 12,
Lines 28 and 30, after "The" replace "method" with -- apparatus --.

Signed and Sealed this

Eleventh Day of June, 2002

*Attest:*

*Attesting Officer*

JAMES E. ROGAN
*Director of the United States Patent and Trademark Office*